US011565368B2

(12) United States Patent
Eldridge

(10) Patent No.: US 11,565,368 B2
(45) Date of Patent: Jan. 31, 2023

(54) SANDING APPARATUS WITH MULTIPLE PART ENGAGEMENT MEMBERS

(71) Applicant: Toyota Motor Engineering & Manufacturing North America, Inc., Plano, TX (US)

(72) Inventor: Kenneth P. Eldridge, Georgetown, KY (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 596 days.

(21) Appl. No.: 16/540,655

(22) Filed: Aug. 14, 2019

(65) Prior Publication Data

US 2021/0046605 A1 Feb. 18, 2021

(51) Int. Cl.

| | |
|---|---|
| ***B24B 41/00*** | (2006.01) |
| ***B24B 41/06*** | (2012.01) |
| *B24B 49/04* | (2006.01) |

(52) U.S. Cl.

CPC ..... *B24B 41/005* (2013.01); *B24B 41/06* (2013.01); *B24B 49/04* (2013.01)

(58) Field of Classification Search

CPC ..... B24B 41/005; B24B 41/06; B24B 49/04; B24B 27/02; B24B 41/066; B24D 15/023; B24D 15/00; B25B 5/006; B25B 5/06

USPC ..... 269/228, 58, 81, 90; 33/568, 573; 451/364, 365

See application file for complete search history.

(56) References Cited

U.S. PATENT DOCUMENTS

| | | | | | |
|---|---|---|---|---|---|
| 1,610,206 | A * | 12/1926 | Gabriel | B24B 23/08 | 451/365 |
| 2,145,980 | A * | 2/1939 | Hadwiger | B24D 9/04 | 451/497 |
| 2,638,805 | A | 5/1953 | Bigelow | | |
| 4,078,338 | A * | 3/1978 | Baughcom | B24D 15/06 | 451/378 |

(Continued)

FOREIGN PATENT DOCUMENTS

| | | | | |
|---|---|---|---|---|
| CN | 203600042 U | * | 5/2014 | B24B 37/27 |
| DE | 10023597 A1 | | 11/2001 | |
| GB | 605884 A | | 8/1948 | |

OTHER PUBLICATIONS

Mitutoyo rotary vise for profile projectors and measuring microscopes—172-144 (http://www.penntoolco.com/mitutoyo-rotary-vise-for-profile-projectors-and-measuring-microscopes-172-144/); accessed May 22, 2019.

(Continued)

*Primary Examiner* — Joseph J Hail
*Assistant Examiner* — Arman Milanian
(74) *Attorney, Agent, or Firm* — Dinsmore & Shohl LLP

(57) ABSTRACT

A method of removing material from a surface of an ultrasound directing element comprising a plastic material is provided. The method includes mounting the ultrasound directing element to a mounting block of a sanding apparatus. The mounting block includes an engagement member that moves from a release position to an engagement position thereby engaging the ultrasound directing element. The mounting block is moved along a base of the sanding apparatus bringing a surface of the ultrasound directing element into contact with a sanding surface. Material is removed from the surface of the ultrasound directing element using the sanding surface.

8 Claims, 4 Drawing Sheets

(56) References Cited

U.S. PATENT DOCUMENTS

| | | | | |
|---|---|---|---|---|
| 4,315,373 | A | 2/1982 | Lenz | |
| 4,819,384 | A | 4/1989 | Clark | |
| 5,191,737 | A * | 3/1993 | Snoddy | B24B 3/36 451/367 |
| 5,220,730 | A | 6/1993 | Cangelosi | |
| 10,759,017 | B2 * | 9/2020 | Powell | B24D 15/06 |
| 2013/0331008 | A1 * | 12/2013 | Andou | B24B 19/226 451/164 |

OTHER PUBLICATIONS

Milling working table 350×100mm bench vise multifunction worktable milling machine compound drilling slide table for diy bench drill (https://www.industrialstore.org/milling-working-table-350100mm-bench-vise-multifunction-worktable/); accessed May 22, 2019.

* cited by examiner

SANDING APPARATUS WITH MULTIPLE PART ENGAGEMENT MEMBERS

TECHNICAL FIELD

The present specification generally relates to sanding apparatuses and, more specifically, to sanding apparatuses that include multiple part engagement members for engaging a part at multiple locations for a sanding operation.

BACKGROUND

Ultrasound apparatuses are frequently used to inspect parts for out-of-parameter conditions. For example, ultrasound apparatuses may be used to inspect welds and check for cracks in metal parts that are difficult to visually identify. The ultrasound apparatuses have an ultrasound transducer and may include an ultrasound directing element, sometimes referred to as a wedge or shoe, that protects the ultrasound transducer from contacting the part being inspected directly and also directs the ultrasound waves therethrough.

The ultrasound directing elements are often formed from a plastic material, such as poly(methyl methacrylate) (PMMA), also known as acrylic or other suitable plastic material. Contact between the ultrasound directing element surfaces and the part being inspected can cause the ultrasound directing elements to wear over time. The wearing of the ultrasound directing element surfaces can adversely affect the effectiveness of the ultrasound apparatuses. What is needed is a sanding apparatus that can be used to remove surface material from the ultrasound directing elements in order to improve their surface finish.

SUMMARY

In accordance with one embodiment, a method of removing material from a surface of an ultrasound directing element comprising a plastic material is provided. The method includes mounting the ultrasound directing element to a mounting block of a sanding apparatus. The mounting block includes an engagement member that moves from a release position to an engagement position thereby engaging the ultrasound directing element. The mounting block is moved along a base of the sanding apparatus bringing a surface of the ultrasound directing element into contact with a sanding surface. Material is removed from the surface of the ultrasound directing element using the sanding surface.

In another embodiment, a sanding apparatus for removing material from a surface of a work piece includes a base and a rail mounted to the base. The rail extends longitudinally along a length of the base. A mounting block includes a carriage that moves along the rail. The mounting block includes a first engagement member configured to engage a first surface of the work piece and a second engagement member configured to engage a different, second surface of the work piece. The mounting block and carriage move along the rail toward and away from a sanding surface.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following description of the illustrative embodiments can be understood when read in conjunction with the following drawings, where like structure is indicated with like reference numerals and in which:

DETAILED DESCRIPTION

Embodiments described herein are generally directed to a sanding apparatus that can be used to remove surface material from ultrasound directing elements in order to improve their surface finish. The sanding apparatus includes multiple engagement members including a clamp that clamps on a top of a ultrasound directing element and a set screw on a side that engages a side of the ultrasound directing element. An adjustment knob adjusts a position of the ultrasound directing element with respect to a sanding surface. The sanding surface is provided by sandpaper that is held on a sanding plate that is part of the sanding apparatus. The sandpaper is moved across a surface of the ultrasound directing element as the ultrasound directing element is held stationary by the sanding apparatus. Different grits of sandpaper may be used to achieve the desired surface finish.

Figure 1:
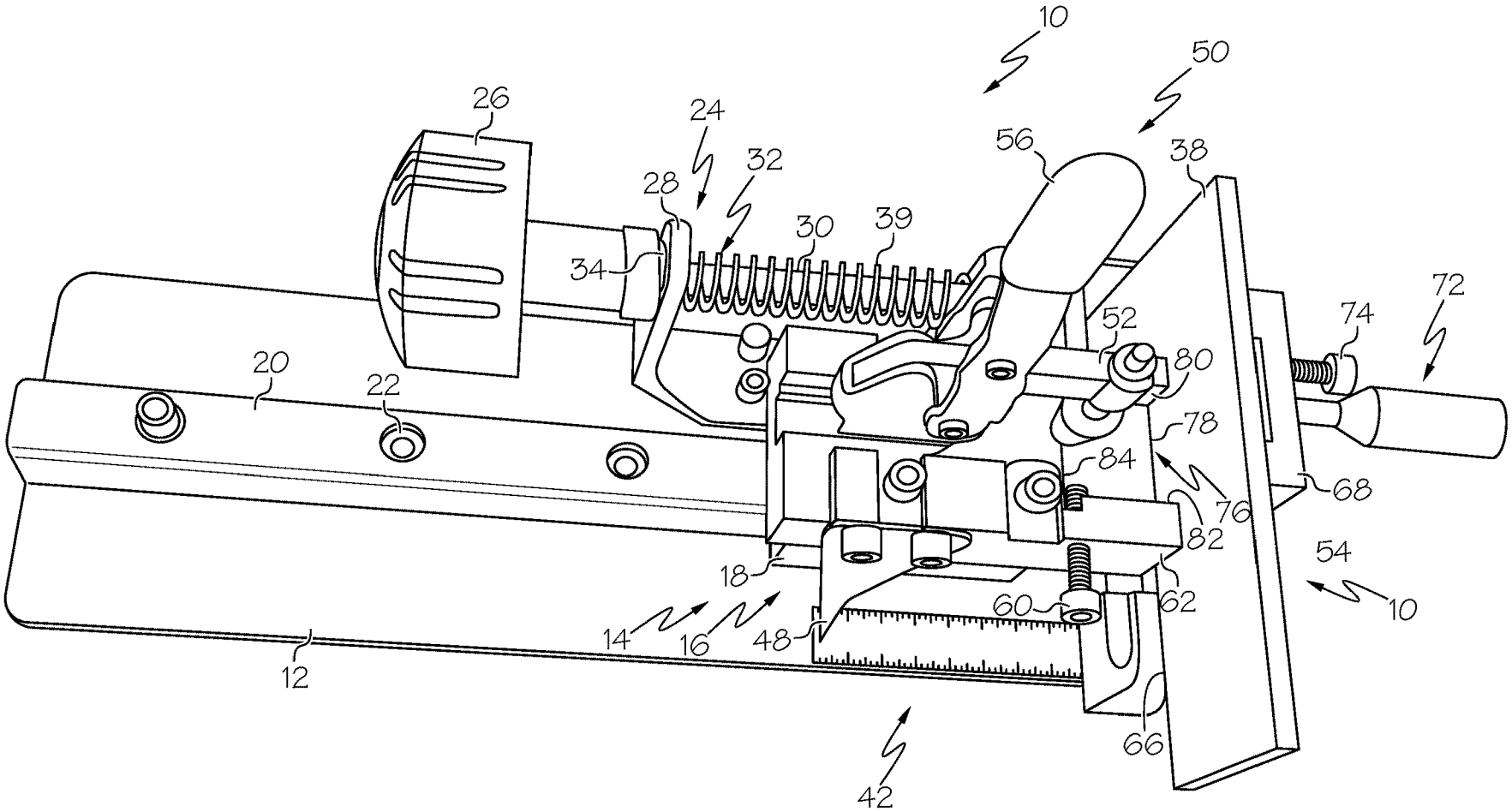
FIG. 1 is a perspective side view of a sanding apparatus suitable for removing material from a surface of an ultrasound directing element, according to one or more embodiments shown and described herein.
Figure 2:
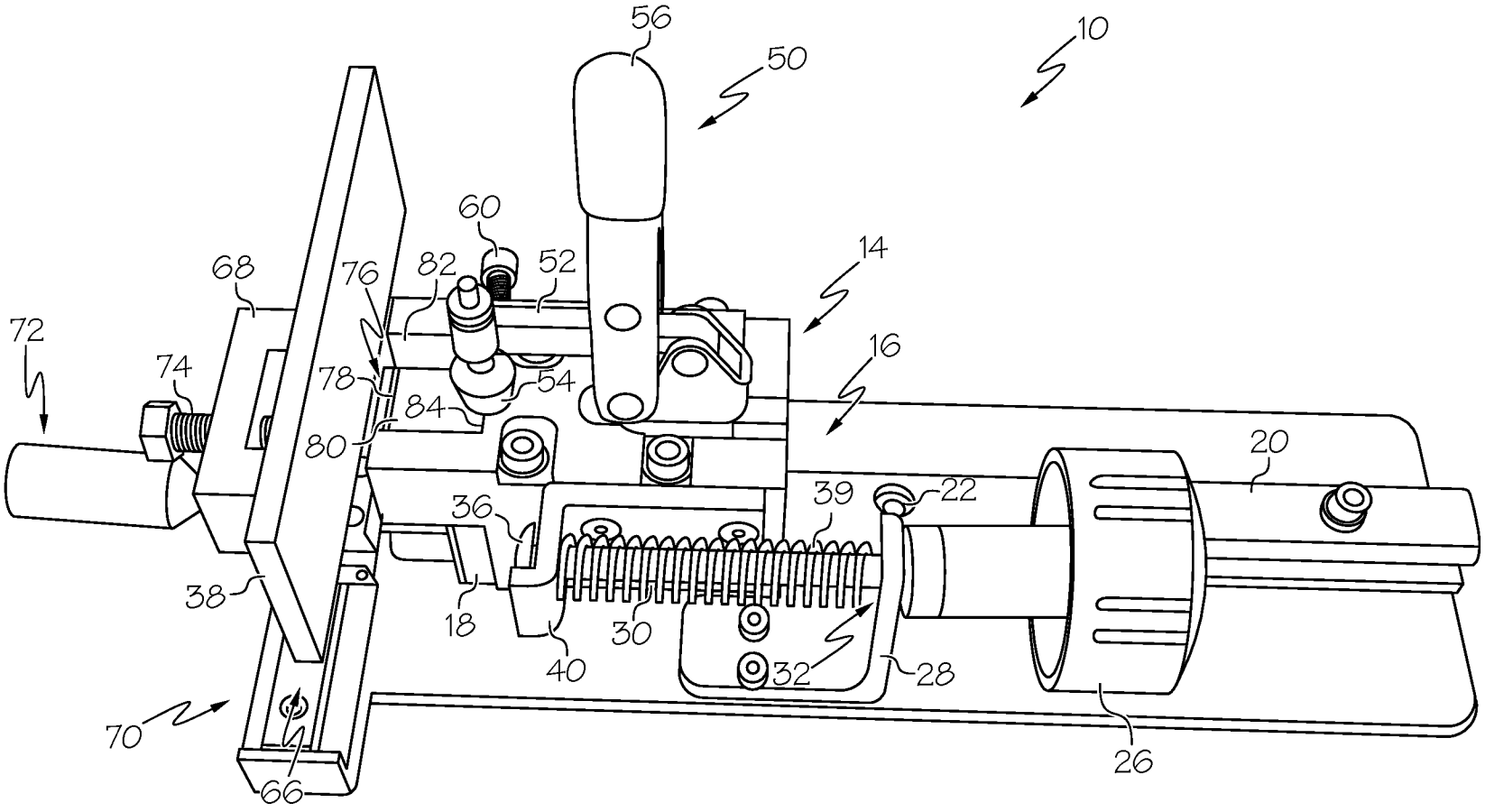
FIG. 2 is another side perspective view of the sanding apparatus of FIG. 1, according to one or more embodiments shown and described herein.

Referring to FIGS. 1 and 2, a sanding apparatus 10 includes a base 12 and a mounting block 14 that is slidably connected to the base 12. The mounting block 14 may include, for example, a linear bearing assembly 16. The linear bearing assembly 16 may include a carriage 18 as part of the mounting block 14 and a rail 20 that is fixedly attached to the base 12 by fasteners 22. The carriage 18 includes an opening that extends therethrough and is sized to slidably receive the rail 20. In some embodiments, the rail 20 may include a groove that mates with the carriage 18 so that the mounting block 14 cannot be lifted from the rail 20 in a vertical direction.

A position of the mounting block 14 along a length of the rail 20 may be precisely adjusted using a position adjusting device 24. The position adjusting device 24 may include a control knob 26 that is threadably attached to a mounting bracket 28 that is fixedly mounted to the base 12. A positioning rod 30 may be connected to the control knob 26 for rotation with the control knob 26 as the control knob 26 is turned. At least a portion 32 of the positioning rod 30 may be threadably connected through an opening 34 in the mounting bracket 28 such that turning the control knob 26 moves an end 36 (FIG. 2) of the positioning rod 30 linearly toward and away from a sanding plate 38 using a spring force from spring 39.

The end 36 of the positioning rod 30 is connected to another mounting bracket 40 that is fixedly mounted to the mounting block 14 (FIG. 2). As may be appreciated, movement of the end 36 linearly toward and away from the sanding plate 38 also results in linear movement of the mounting block 14 toward and away from the sanding plate 38 due to the spring force from the spring 39.

Referring to FIG. 1, the sanding apparatus 10 may include a distance measuring device 42 (e.g., a ruler) may be provided that can be used to measure a distance that the mounting block 14 has travelled during a sanding operation. This distance travelled of the mounting block 14 can also provide an indication of how much material is being removed from a work piece 44 (FIG. 3), such as an ultrasound directing element. As used herein, an "ultrasound directing element" refers to a wedge or shoe that allows transmission of ultrasound waves therethrough and is suitable for use in an ultrasound imaging apparatus, such as commercially available from Toshiba Company. A pointer 48 may be mounted on the mounting block 14 that can be used to facilitate identification of change in distance in a more accurate manner.

Referring again to FIGS. 1 and 2, the sanding apparatus 10 includes multiple engagement members that hold the work piece 44 in place for the sanding operation. The engagement members include a clamp 50 that clamps on a top of the work piece 44. The clamp 50 includes a clamp arm 52 that includes an engagement element 54 located at an end of the clamp arm 52. The engagement element 54 may be, for example, rubber, plastic or other soft material. A locking handle 56 may be provided to lock the clamp arm 52 and the engagement element 54 in an engaged position with the engagement element 54 locked against a top surface 58 of the work piece 44. To provide another engagement location, a set screw 60 is provided on a side 62 that engages a side 64 of the work piece 44.

Figure 3:
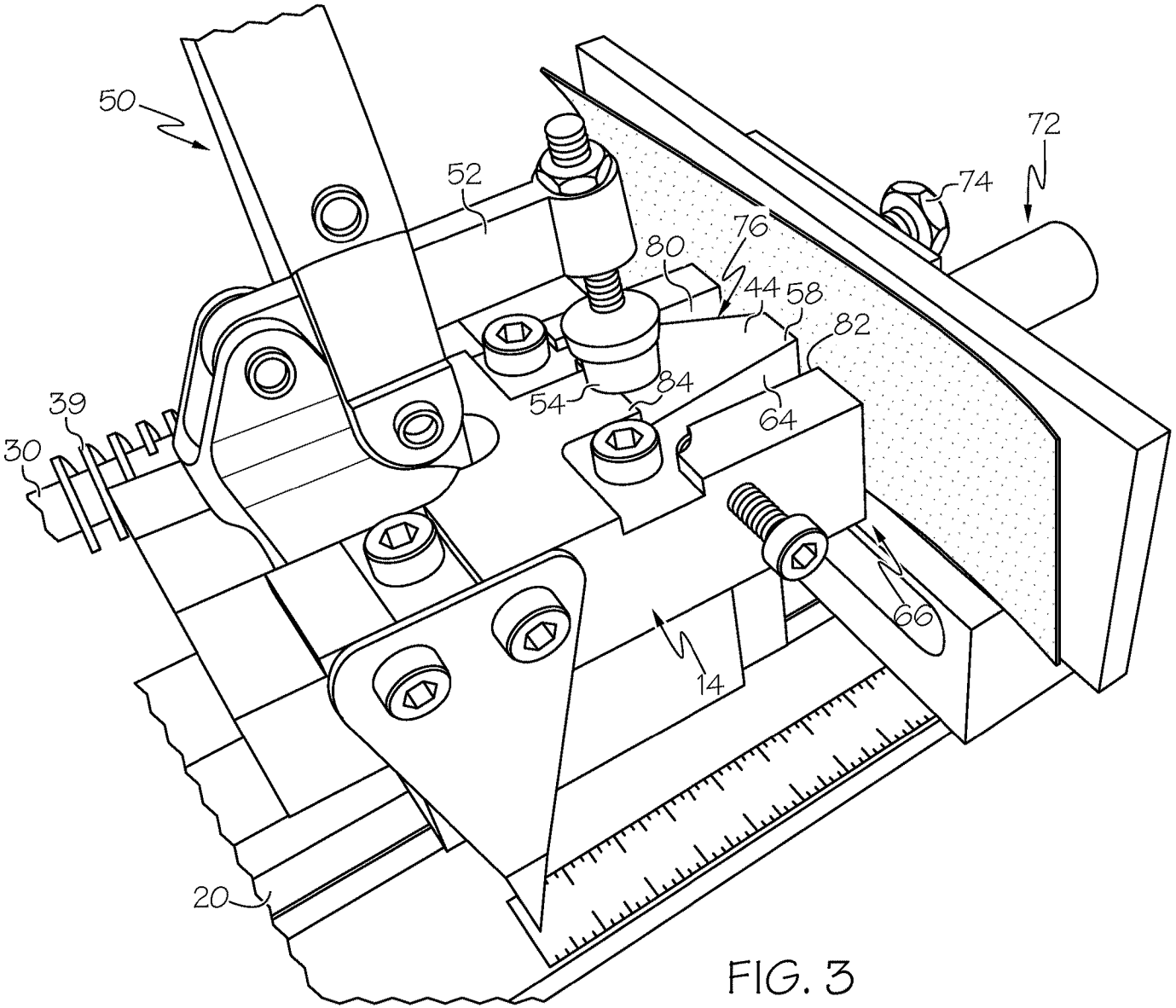
FIG. 3 is a detail perspective view of the sanding apparatus of FIG. 1, according to one or more embodiments shown and described herein.

Referring also to FIG. 3, the sanding apparatus 10 further includes the sanding plate 38. The sanding plate 38 may be slidably received in a groove 66 that is provided between the mounting block 14 and an end block 68 (FIGS. 1 and 2) that is provided at an end 70 of the base 12. In some embodiments, the end block 68 may be adjustably mounted to the base 12 to allow for movement of the end block 68 toward and away from the end block 68. For example, another control knob 72 may be threadably connected to the end block 68 to allow for adjustment of a position of the end block 68. In some embodiments, another set screw 74 may be used to abut the sanding plate 38.

Referring still to FIGS. 1-3, a holding volume 76 is provided at a leading edge 78 of the mounting block 14. The holding volume 76 is formed as a recess and defined between side walls 80 and 82 and a back wall 84. The back wall 84 forms a ledge against which the engagement element 54 can rest when not in use.

Figure 4:
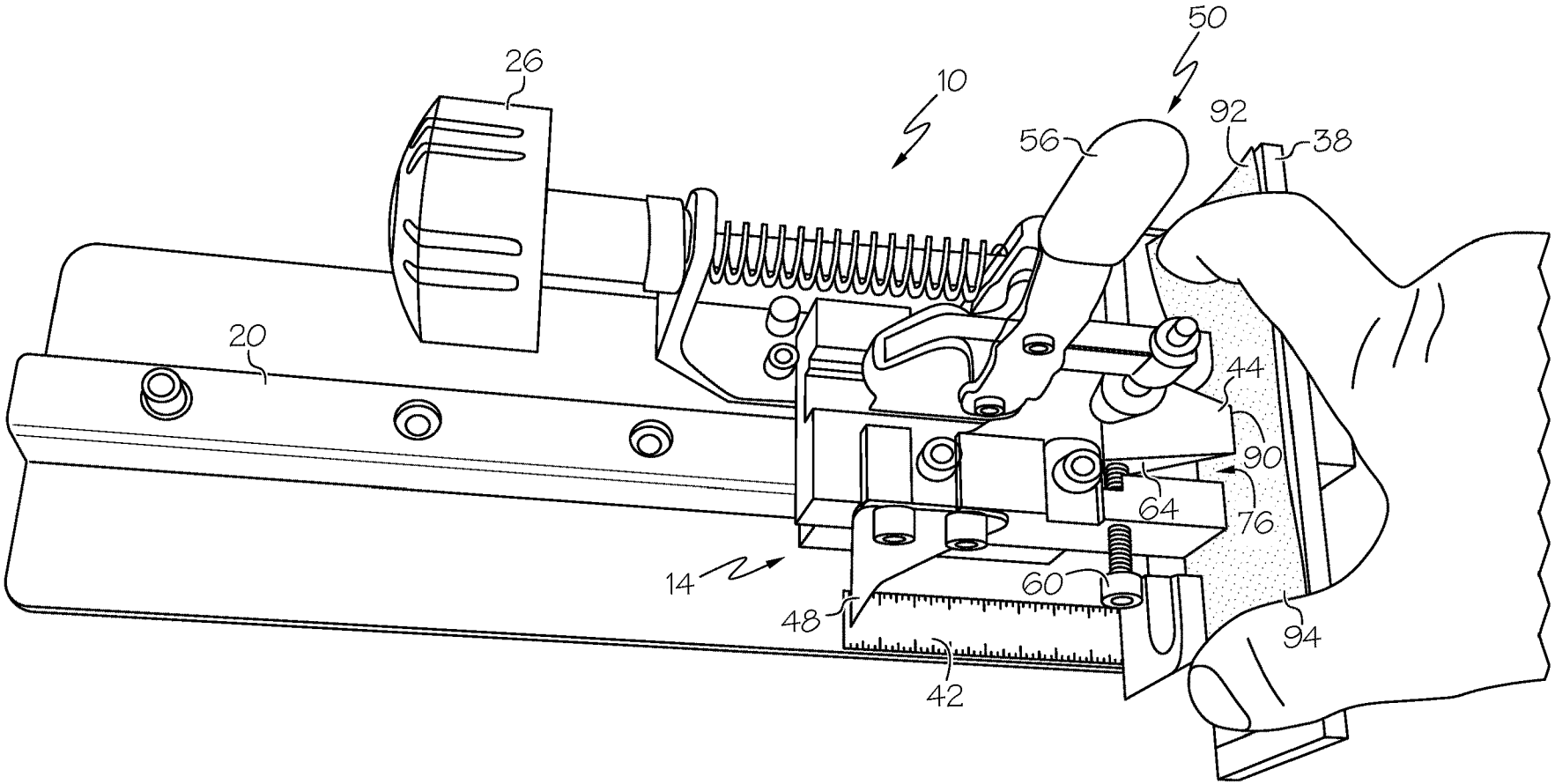
FIG. 4 is a side perspective view of the sanding apparatus of FIG. 1 in use, according to one or more embodiments shown and described herein.

Referring to FIG. 4, the sanding apparatus 10 is illustrated in use. The mounting block 14 may be moved along the rail 20 away from the sanding plate 38, if needed, to provide some clearance between the mounting block 14 and the sanding plate 38. The clamp 50 and the set screw 60 may be placed in release configurations such that the ultrasound directing element 44 can be located in the holding volume 76 with a surface 90 facing the sanding plate 38. The clamp 50 may be placed in an engagement configuration by moving the locking handle 56. The set screw 60 may be placed in an engagement position by turning the set screw 60 until the set screw 60 abuts the side 64 of the ultrasound directing element 44.

A linear position of the mounting block 14 may be adjusted toward the sanding plate 38 using the control knob 26. A piece of sandpaper 92 may be introduced between the mounting block 14 and a sanding surface 94 provided by the sandpaper 92. The sandpaper 92 may be manually held against the sanding plate 38. The surface 90 may be brought into contact with the sanding surface 94. The user may determine an initial position of the mounting block 14 using the measuring device 42 and pointer 48. In order to remove material from the surface 90 of the ultrasound directing element 44, the sanding plate 38 including the sandpaper 92 held thereon are moved laterally (i.e., perpendicular to the rail 20). As material is removed, the mounting block 14 may be moved linearly along the rail 20 to continue removing material. Once a desired surface finish for surface 90 is reached, a final position may be determined using the measuring device 42 and pointer 48 and a difference between the initial and final positions can provide an indication of how much material is removed.

The above-described sanding apparatuses provide a mounting block that is suitable for mounting an ultrasound directing element thereto and removing material from a surface of the ultrasound directing element at a proper angle. The material can be removed from the surface of the ultrasound directing element at a controlled rate that can be measured by a distance measuring device. Different grits of sandpaper (e.g., 220, 800, 2000 and 3000) and combinations thereof may be used for a desired surface finish. The sanding apparatuses can help achieve a more repeatable process for removing material from the surfaces of the ultrasound directing elements.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A method of removing material from a surface of an ultrasound directing element comprising a plastic material, the method comprising:

mounting the ultrasound directing element to a mounting block of a sanding apparatus, the mounting block comprising an engagement member that moves from a release position to an engagement position thereby engaging the ultrasound directing element;

moving the mounting block along a base of the sanding apparatus and bringing a surface of the ultrasound directing element into contact with a sanding surface; and removing material from the surface of the ultrasound directing element using the sanding surface;

wherein the sanding apparatus comprises a rail extending longitudinally along the base, the mounting block comprising a carriage that slides along the rail to adjust a linear position of the mounting block along the base.

2. The method of claim 1, wherein the engagement member comprises a clamp that clamps on a top surface of the ultrasound directing element.

3. The method of claim 2, wherein the engagement member is a first engagement member, the sanding apparatus comprising a second engagement member that moves from a release position to an engagement position thereby engaging the ultrasound directing element at a location different from the clamp.

4. The method of claim 1, wherein the mounting block has a holding volume that is formed as a recess in the mounting block, the holding volume being sized to receive the ultrasound directing element.

5. The method of claim 1 further comprising holding sandpaper against a sanding plate of the sanding apparatus thereby providing the sanding surface.

6. The method of claim 5 further comprising moving the sanding block thereby removing material from the surface of the ultrasound directing element using the sanding surface.

7. The method of claim 6, wherein the sanding block is moved manually.

8. The method of claim 1, wherein the sanding apparatus comprises a position adjusting device that is operatively connected to the mounting block for moving the mounting block along the rail.

* * * * *